United States Patent [19]

Meister

[11] Patent Number: 4,920,525

[45] Date of Patent: Apr. 24, 1990

[54] QUIET ALARM CLOCK

[76] Inventor: Jack B. Meister, 68 Chimney Ridge Dr., Covent Station, N.J. 07961

[21] Appl. No.: 267,236

[22] Filed: Nov. 3, 1988

Related U.S. Application Data

[63] Continuation-in-part of Ser. No. 197,742, May 23, 1988, abandoned.

[51] Int. Cl.[5] ..... G04C 21/00; G04B 37/00

[52] U.S. Cl. ..... 368/250; 368/88; 368/276

[58] Field of Search ..... 368/72–74, 368/88, 230, 243, 244, 250, 276, 315–317

[56] References Cited

U.S. PATENT DOCUMENTS

| | | | |
|---|---|---|---|
| 1,651,804 | 12/1927 | Bosch | 368/317 |
| 3,361,973 | 1/1968 | Wysong | 368/12 |
| 3,977,177 | 8/1976 | Egger | 368/250 |
| 4,028,882 | 6/1977 | Muncheryan | 368/250 |
| 4,081,952 | 4/1978 | Busch et al. | 368/277 |
| 4,093,944 | 6/1978 | Muncheryan | 368/12 |
| 4,390,289 | 6/1983 | Houlihan | 368/316 |
| 4,432,653 | 2/1984 | Ting-Ching | 368/250 |
| 4,456,387 | 6/1984 | Igarashi | 368/230 |
| 4,472,065 | 9/1984 | Goodman | 368/230 |
| 4,768,177 | 8/1988 | Kehr et al. | 368/10 |

FOREIGN PATENT DOCUMENTS

| | | | |
|---|---|---|---|
| 2836650 | 11/1979 | Fed. Rep. of Germany | 368/276 |
| 1045554 | 6/1988 | United Kingdom . | |

*Primary Examiner*—Vit W. Miska

*Attorney, Agent, or Firm*—Barnes, Kisselle, Raisch, Choate, Whittemore & Hulbert

[57] ABSTRACT

A quiet alarm clock comprising a flat rectangular enclosure, and a motor-driven eccentric vibrator positioned within the enclosure. An electronic clock module is removably fastened within the enclosure, and includes a self-contained battery power source, switches for selectively setting time of day and alarm time and an alphanumeric clock display positioned on one wall of the enclosure for ready observation by a user. An alarm output from the clock is fed to a solid-state electronic switch that applies electrical power to the vibrator motor from a second battery power source within the enclosure. The clock module includes an operator panel positioned adjacent to the display and having the time-setting switches mounted thereon, and a hinged flap for removably covering the panel while permitting viewing of the display, whereby the clock module may be employed as a pocket watch separate from the quiet alarm.

10 Claims, 2 Drawing Sheets

QUIET ALARM CLOCK

This application is a continuation-in-part of application Ser. No. 197,742 filed May 23, 1988 and now abandoned.

The present invention is directed to alarm clocks, and more particularly to a clock that may be selectively set and employed for awakening an individual without alerting or disturbing other nearby individuals.

BACKGROUND AND OBJECTS OF THE INVENTION

Quiet alarms of the described character have many important applications and uses. For example, such an alarm could be employed by one spouse to awaken at an early hour without disturbing the other spouse. An alarm of the described character could be employed by an incontinent individual, such as a young child having a bed-wetting problem, to awaken at a preselected time during the night without disturbing others in the surrounding area. A non-audible alarm may also be employed by the hearing impaired.

Quiet alarms heretofore proposed have comprised either a wristwatch-type device or a wake-up device. Wristwatch devices employ the same battery to power both the clock and alarm portions of the device. The alarm may comprise either an electric shack shock mechanism or a pulsating solenoid. In either case, to achieve adequate battery life, power consumed by the alarm must be minimal. For this reason, wristwatch devices of this character are adapted primarily to provide a time reminder to an awake individual, but not to awaken a sleeping individual. Furthermore, many individuals do not wish to sleep wearing a wristwatch.

Wake-up devices proposed in the art employ utility power (117 V.A.C.) and an electrical power cord. Such cord presents a possible entanglement and shock hazards. Moreover, devices of this character are not portably usable. A mechanical or electromechanical switch, with inherent reliability problems, is employed to apply electrical power to the alarm device.

An object of the present invention, therefore, is to provide an alarm clock that may be selectively set by a user to awaken or otherwise alert the user at a preselected time without disturbing or alerting other individuals or persons in the area. Another object of the invention is to provide a silent alarm of the described character that is of compact battery-operated construction, and that may be readily placed beneath the user's pillow, for example, or in the user's pocket without being noticeable or uncomfortable to the user. A further object of the invention is to provide a silent alarm clock of the described character in which the alarm device is powered by readily replaceable high-energy batteries, while the clock itself is powered by a separately replaceable long-life battery. Yet another object of the invention is to provide a quiet alarm clock of the described character in which the clock portion is removable as a module and may be employed as a pocket watch.

SUMMARY OF THE INVENTION

A quiet alarm clock in accordance with a presently preferred embodiment of the invention comprises a flat rectangular enclosure, and a vibrator including an electric motor positioned within the enclosure. An electronic clock is mounted within the enclosure. The clock includes a selfcontained battery power source, switches for selectively setting time of day and alarm time, and an alphanumeric clock display positioned on one wall of the enclosure for ready observation by a user. An alarm output from the clock is fed to a solid-state electronic switch that applies electrical power to the vibrator motor from a second battery power source within the enclosure.

In the preferred embodiment of the invention, the electronic clock comprises a separate module removably fastened within a generally rectangular pocket on one wall of the enclosure. Mating electrical connectors on the clock module and in the enclosure pocket serve the dual function of securing the clock module within the enclosure pocket and feeding the clock alarm signal to the solid-state switch. The vibrator preferably comprises a motor-driven eccentric powered by a pair of AA batteries removably positionable within the enclosure through the enclosure pocket when the clock module is removed therefrom. The clock module includes an operator panel positioned adjacent to the display and having the time-setting switches mounted thereon, and a hinged flap for removably covering the panel while permitting viewing of the display, whereby the clock module may be readily employed as a pocket watch separate from the quiet alarm.

BRIEF DESCRIPTION OF THE DRAWINGS

The invention, together with additional objects, features and advantages thereof, will be best understood from the following description, the appended claims and the accompanying drawings in which:

DETAILED DESCRIPTION OF PREFERRED EMBODIMENT

Figures 1, 2:
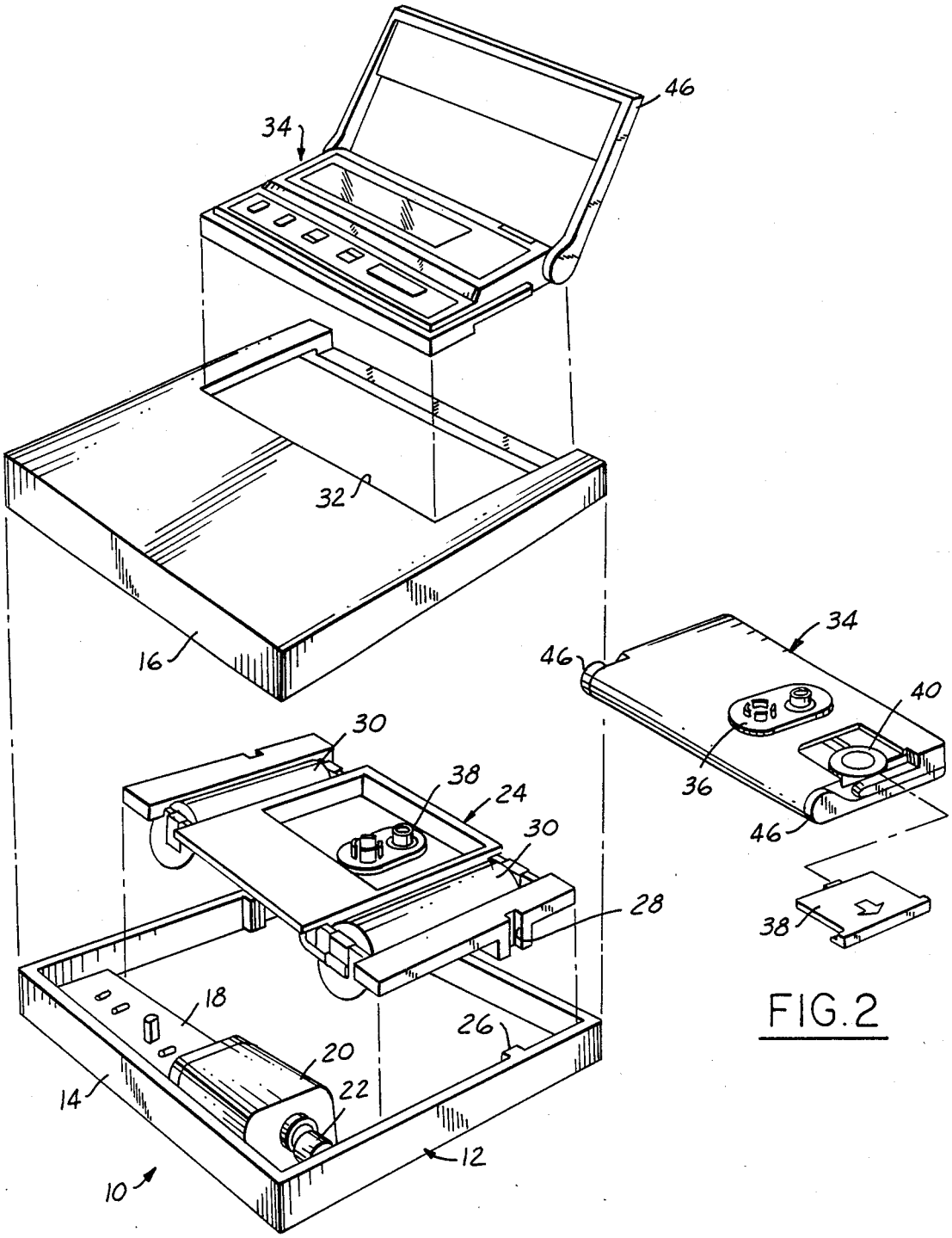
FIG. 1 is an exploded perspective view of a quiet alarm clock in a presently preferred embodiment of the invention.
FIG. 2 perspective view of the clock module in FIG. 1.
Figure 3:
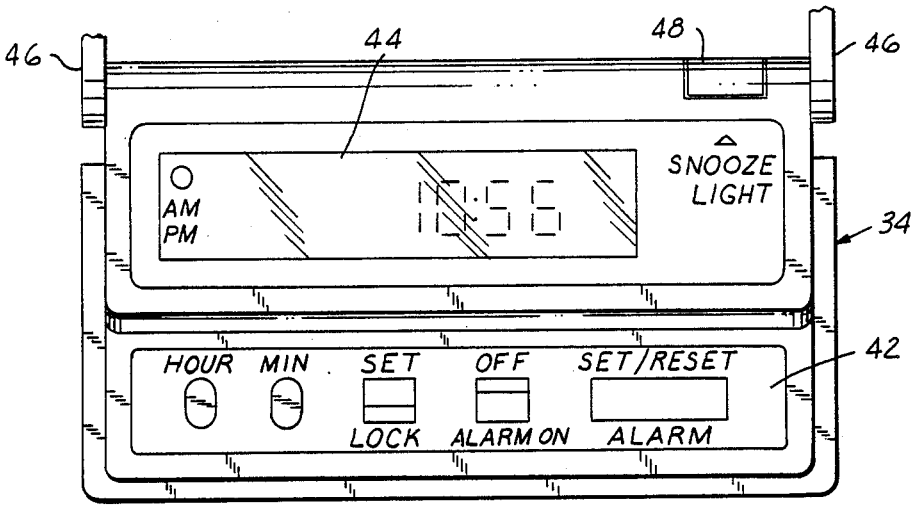
FIG. 3 is a fragmentary top elevational view of the clock module panel exposed.

A quiet alarm clock 10 in accordance with a presently preferred embodiment of the invention comprises a generally rectangular enclosure 12 having an open base 14 and a cover 16 secured thereto. A circuitboard assembly 18 is secured along the front edge within base 14 adjacent to a rotary electric motor 20 having an output shaft coupled to an eccentric 22. A battery platform 24 is captured within base 14 and held in position by ribs 26 integral with the side walls of base 14 that engage opposed notches 28 in battery platform 24. A pair of AA batteries 30 are removably positioned within corresponding pockets on platform 24 adjacent to the lateral side edges thereof, and are electrically connected to circuitry 18 and motor 20. A generally rectangular pocket is formed by an opening 32 in cover 16 and the underlying portion of battery platform 24. An electronic clock module 34 is removably positioned within opening 32, and is secured therein by snap-fit engagement of opposed mating electrical connectors 36, 38 on the base of clock module 34 and the upper surface of battery platform 24 respectively. With clock module 34 removed, batteries 30 may be selectively replaced within battery platform 24.

Clock module 34 includes a removable slide-cover 38 (FIG. 2) for replacement of the lithium battery 40 that powers the clock module. On the upper surface of clock module 34, there are disposed an operator panel 42 and an adjacent LCD alphanumeric display 44. Display 44 displays the time, AM or PM, and an indication whether the alarm is turned "ON". The various control switches on panel 42, to turn the alarm "ON" or "OFF" and to set the day and alarm times, are protected by a hinged flap panel 46 to prevent accidental operation of these switches. Clock module 34 also has a momentary switch 48 to light the display and operate a "snooze" function, which stops alarm vibrations and turns them "ON" again after four minutes.

Figure 4:
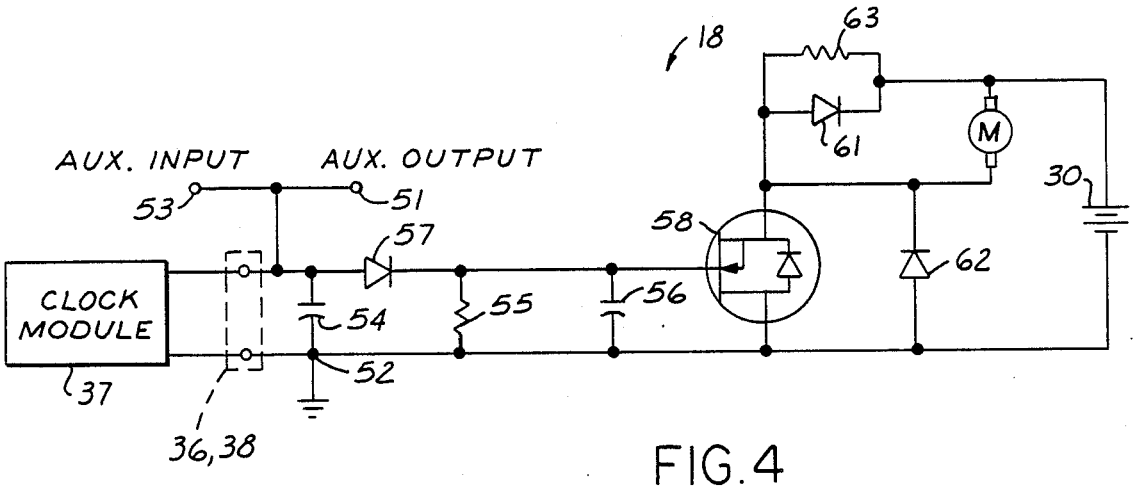
FIG. 4 is an electrical schematic diagram of the quiet alarm clock illustrate in FIGS. 1–3.

FIG. 4 is an electrical schematic diagram of the alarm circuit 18. Clock module 34 is a digital alarm clock (Integrated Display Technology, Ltd., Alarm Clock Model 63706). The audible alarm is removed and the two wires from the audible alarm output of module 34 are attached to the alarm circuit at connecters 36, 38. The alarm signal passes through a filter circuit 54, 55, 56 and a diode 57 for reverse voltage protection. The signal then turns "ON" a transistor 58 that completes a circuit from batteries 30 to motor 20. Eccentric weight 72 (FIG. 1) on the motor shaft causes vibration when the motor rotates. The other components, two diodes 61 and 62 and a resistor 63, are to filter the electrical noise from the motor brushes. If it is desired to activate the alarm from an external signal source, this source can be connected to the auxiliary input 53 and ground 52 terminals. For example, the alarm circuit may be connected to a microphone and amplifier to alert a hearing person to noises such as a ringing telephone, a smoke alarm, etc. The clock module may also drive external audible alarm, for example, through an auxiliary output 51.

The invention claimed is:

1. An alarm clock comprising:

a flat rectangular enclosure, a vibrator including an electric motor positioned within said enclosure and responsive to application of electrical power for emitting mechanical vibration energy, an electronic clock mouted within said enclosure and including a self-contained battery power source, means for setting time of day and alarm time at said clock, an alphanmeric clock display positioned in one wall of said enclosure, and an alarm output, and means including a second battery power source and solid-state electronic switch means within said enclosure responsive to said alarm output for connecting said second battery power source to said electric motor, said electronic clock, including said self-contained battery power source, said time setting means and said display, comprising a separate module removably fastened within said enclosure, said enclosure including a generally rectangular pocket on said one wall, said electronic clock module being removable positioned in said pocket, there being mating electrical connection means on said module and in said pocket for securing said module in said pocket and feeding said alarm signal to said solid-state switch means.

2. An alarm clock comprising:

a flat rectangular enclosure, a vibrator including an electric motor positioned within said enclosure and responsive to application of electrical power for emitting mechanical vibration energy, an electronic clock mounted within said enclosure and including a self-contained battery power source, means for setting time of day and alarm time at said clock, an alphanumeric clock display positioned in one wall of said enclosure, and an alarm output, and means including a second battery power source and solid-state electronic switch means within said enclosure responsive to said alarm output for connecting said second battery power source to said electric motor, said electronic clock, including said self-contained battery power source, said time setting means and said display, comprising a separate module removably fastened within said enclosure, said enclosure including a pocket on said one wall, said electronic clock module being removably positioned in said pocket, there being means on said module and in said pocket for securing said module in said pocket and feeding said alarm signal to said solid-state switch means.

3. The clock set forth in claim 2 wherein said module-securing means comprises mating electrical connection means securely fastened on said module and within said pocket for simultaneously securing said module within said pocket and feeding said alarm signal to said switch means.

4. The clock set forth in claim 3 wherein said module and said pocket are of identical substantially rectangular outline.

5. The clock set forth in claim 2 wherein said electric motor comprises a rotary electric motor and an eccentric mounted on said motor.

6. The clock set forth in claim 2 wherein said second battery power source comprises a pair of AA batteries removably positionable in said enclosure through said pocket with said module removed.

7. The clock set forth in claim 6 wherein said clock module includes an operator panel positioned adjacent to said display and having said time-setting means mounted thereon, and a hinged flap for removably covering said panel while permitting viewing of said display.

8. An alarm clock comprising:

an alarm module comprised of an enclosure, a vibrator including an electric motor positioned within said enclosure and responsive to application of electrical power for emitting mechanical vibration energy, means including a first battery power source and solid-state electronic switch means with said enclosure responsive to an electronic alarm signal for connecting said first battery power source to said electric motor, and an electronic clock module including an electronic clock with a self-contained second battery power source, means for setting time of day and alarm time at said clock, an alphanumeric clock display positioned in one wall of said enclosure, and means for providing said alarm signal, and means for removably mounting said clock module within said enclosure such that said time-setting means and said display are accessible on one wall of said enclosure.

9. The clock set forth in claim 8 further comprising electrical connection means on said clock module and within said enclosure for feeding said alarm signal output from said clock to said switch means when said clock module is mounted within said enclosure.

10. The clock set forth in claim 8 wherein said enclosure includes a generally rectangular pocket on said one wall, said electronic clock module being removably positioned in said pocket, there being mating electrical connection means on said module and in said pocket for securing said module in said pocket and feeding said alarm signal to said solid-state switch means.

* * * * *